United States Patent [19]

Quillan et al.

[11] Patent Number: 4,974,620

[45] Date of Patent: Dec. 4, 1990

[54] INVALID WALKER AND SEAT

[76] Inventors: Marie A. F. Quillan, 1719 Cara Cres, Orleans, Ont., K4A 1M5; Cora M. E. Folks, 145 Park Ave., Holland Landing, Ont., Canada, L0G 1H0

[21] Appl. No.: 443,176

[22] Filed: Nov. 30, 1989

[51] Int. Cl.[5] ..... A61H 3/00

[52] U.S. Cl. ..... 135/67; 297/219; 297/188; 108/25

[58] Field of Search ..... 135/65, 67, 68, 66; 108/25 X; 297/229, 219 X, 188 X

[56] References Cited

U.S. PATENT DOCUMENTS

| | | | |
|---|---|---|---|
| 2,798,533 | 7/1957 | Frank | 135/67 |
| 3,034,153 | 5/1962 | Sargent | 108/25 |
| 3,993,349 | 11/1976 | Neufeld et al. | 135/67 |
| 4,065,140 | 12/1977 | Cadwalader | 135/66 |
| 4,122,780 | 10/1978 | Brickman | 108/25 |
| 4,184,618 | 1/1980 | Jones | 135/67 |
| 4,295,483 | 10/1981 | Smith | 135/66 |
| 4,518,198 | 5/1985 | Daniels | 297/229 |
| 4,532,948 | 8/1985 | Burrows | 135/67 |
| 4,621,804 | 11/1986 | Mueller | 135/67 |
| 4,643,211 | 2/1987 | Morris et al. | 135/67 |
| 4,676,416 | 6/1987 | Harmon | 135/67 |
| 4,850,383 | 7/1989 | McBride | 135/66 |
| 4,863,003 | 9/1989 | Carter | 297/188 |
| 4,892,353 | 1/1990 | Coddard | 297/188 |

FOREIGN PATENT DOCUMENTS

| | | | |
|---|---|---|---|
| 1165671 | 10/1958 | France | 297/188 |

*Primary Examiner*—Henry E. Raduazo
*Attorney, Agent, or Firm*—Stanley E. Johnson

[57] ABSTRACT

An invalid walker with a seat preferably removably mounted thereon and wherein the seat is a band of material with one or more pockets therein on a portion of the band that depends from the handrail of the walker. The band has two spaced apart loops formed therein for attaching the seat to the handrails of the walker. The handrails of the walker can slide into the loops or rods can be slid into the loops and hooks used, attached at one end to the rods and at the other end to the handrails detachably mounting the band on the walker. The loops in the band can, if desired, be provided with zipper closure means thereby making the seat removably mountable.

11 Claims, 3 Drawing Sheets

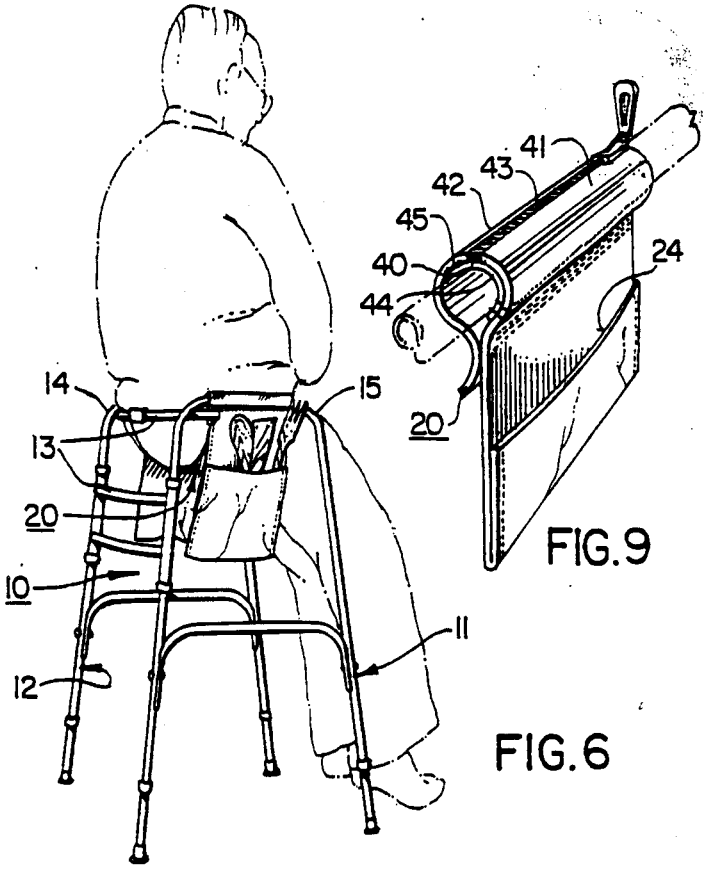
FIG.9
FIG.6
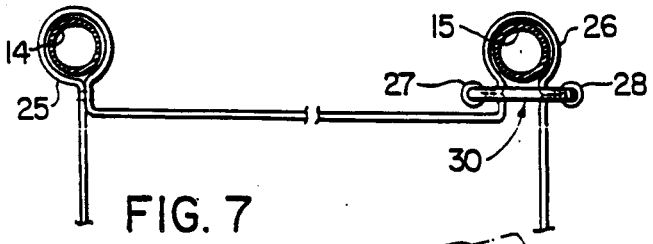
FIG. 7
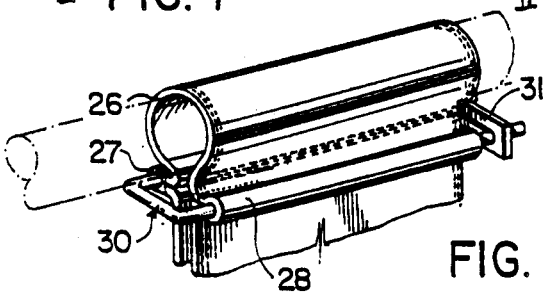
FIG. 8

INVALID WALKER AND SEAT

FIELD OF INVENTION

This invention relates to improvements in invalid walkers and more particularly to an invalid walker with a seat thereon for the user.

BACKGROUND OF INVENTION

Walkers for invalids are well known and provide a support for someone disabled or partially disabled, giving them mobility which they otherwise would not enjoy. At present, however, the walkers are used just for that one purpose and should the user of the walker become fatigued or have some task they wish to perform, they have to find the nearest available chair or support on which they can sit. For someone who is disabled and gets tired while using the walker, the nearest chair as a place to rest can seem and effectively be miles away for that disabled person. A walker is used by hanging onto it and this precludes one from using their hands to do other tasks. This often results in having to ask someone else for assistance which takes away from the person's independence, often adversely affecting their self-worth, resulting in low self-esteem. There is also the frustration for the user of being unable to accomplish tasks which before using the walker were everyday normal occurrences to them.

SUMMARY OF INVENTION

A principle object of the present invention is to give the user of invalid walkers more freedom, comfort and the ability to undertake everyday tasks with more comfort and ease.

In accordance with the present invention, a walker is provided with a seat consisting of a flexible band which can be selectively used by the user of the walker to sit on, should the user so desire, and at the same time cause little or no interference with the use of the walker for its intended purpose. If the user gets tired while walking, all they need to do is just turn around and sit on the seat, thereby providing, immediately at hand, a comfortable rest station. The seat on the walker enables the user to sit while preparing meals or having a snack. The seat is preferably made from a waterproof fabric and can be used to sit on while taking a shower, drying very quickly thereafter. The material is selected for its strength and durability and preferably is heavy duty 100% nylon, of the type generally found in conventional travel luggage. The seat is provided with one or more pockets, making it possible to carry small necessities such as toiletries, wallets, food utensils, reading material and the like.

In accordance with the present invention, there is particularly provided an improved invalid walker comprising a frame having legs and a pair of spaced apart, horizontal, handrails for grasping by the user of the walker and a flexible band, mounted on said handrails and depending therefrom, selectively providing a seat for the user of the walker. In accordance with a specific aspect of the invention there is provided a band detachably mountable on an invalid walker, selectively to provide a seat for the user of the walker wherein such band comprises a band of flexible material having reinforcements extending lengthwise along opposite marginal edges thereof. Opposed end portions of the band are folded upon and attached to the band along the marginal edges, providing open-top pockets. A pair of parallel, spaced apart loops are formed in the band and extend transversely thereacross for receiving respective ones of the pair of spaced apart handrails on the walker. If desired, one or both of the loops can be opened and closed by, for example, a zipper, snap-fastener or the like type of opening making the band readily demountably attachable on the handrails of the walker.

LIST OF DRAWINGS

The invention is illustrated by way of example in the accompanying drawings wherein:

FIG. 6 illustrates the seat aspect of the walker in use;

FIG. 7 is a diagrammatic cross-sectional view of the seat attached to the handrails of the walker with the left hand portion being one embodiment, corresponding to the embodiment of FIGS. 2 and 3 and the right hand half portion being a second embodiment;

FIG. 8 is a perspective enlarged view of the second embodiment rendering the band detachably mountable on the handrail;

FIG. 9 is a view similar to FIG. 8, illustrating a further embodiment for detachably attaching the band to the handrails.

DESCRIPTION OF PREFERRED EMBODIMENT

Figure 1:
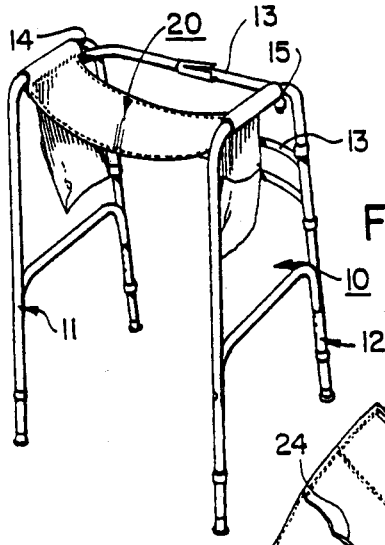
FIG. 1 is an oblique view of an invalid walker having a seat in accordance with the present invention.

Referring to the drawings, there is illustrated in FIGS. 1 and 6, an invalid walker 10 having, in accordance with the present invention, a seat 20 mounted thereon. The walker 10 consists of two essentially A-frames 11 and 12, connected across the front of the walker by folding link means 13. The top part of the A-frames 11 and 12 have respective horizontal handrails 15 and 14, around which the band providing the seat 20 is looped. The A-frames provide the legs for the walker, the lower ends of which are conventionally telescopically adjustable. The two A-frames, along with the folding links 13 interconnecting the same, provide effectively in top plan view, a U-shape frame which partially goes around the user. While walking, the user grasps the upper horizontal handrails 14 and 15 and is in a direction facing the connecting links 13. Should the user become fatigued, all they need do is turn around and sit down on the seat 20. Since seat 20 is a flexible band suspended from the handrails it is somewhat below the handrails and the handrails thus can provide arm rests or at least stabilize the person in position while resting. This gives the user a feeling of security while sitting. The links 13, at the front of the walker, provide a backrest.

Figure 2:
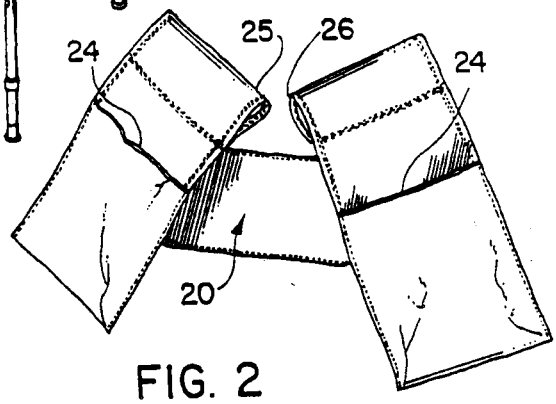
FIG. 2 is a perspective view of the seat portion only.
Figure 3:
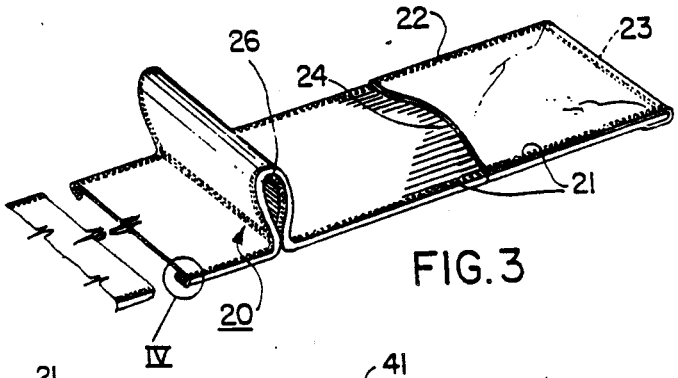
FIG. 3 is a partial oblique view of the seat in its flattened out condition.

The seat 20 is illustrated in more detail in FIGS. 2 and 3. Referring to these figures, the seat 20 is a band of flexible material, approximately 6″ wide and 5′ long, with the ends folded back and stitched to the band along the sides as indicated at 21 and 22 and at the end as indicated at 23. The folded back portion provides an open topped pocket 24. The attachment of the folded back portion to the band can be by multi-seam sewing (as shown) adhesion and/or fusing. The band is further folded upon itself at two spaced apart locations, transversely of the length of the band. The band is joined to itself at a position spaced from the fold line by, for example, triple line stitching, adhesion and/or fusion. This provides respective loops 25 and 26 in the band that slip fit onto respective ones of the pair of spaced apart handrails on the walker.

As an alternative to joining the band to itself to form the loop, FIG. 7 illustrates one means of accomplishing the same by using a U-shaped bolt 30, that passes through respective ones of a pair of small, first and second loops 27 and 28 in the band. The free, outer end of the legs of the U-shaped bolt can be joined one to the other in any convenient manner, providing rigidity or strength to the coupling as, for example, an apertured plate 31 that slides onto the legs.

A still further alternative embodiment is illustrated in FIG. 9 for detachably connecting the flexible band to the handrail of the walker. Referring to FIG. 9, band 20 is attached to itself by, for example, triple seam sewing forming a loop for receiving the handrail corresponding to one of loops 25 and 26 illustrated in FIG. 7. In the embodiment of FIG. 9, the loop is slit longitudinally providing a gap as at 40 between flap portions 41 and 42. These flap portions are detachably interconnected by a zipper 43. The joint is further reinforced by a flap 44, connected as by stitching to flap 41 and detachably connected to flap 42 as by, for example, velcro means 45. The flap 44 underlies the zipper, joining together flaps 41 and 42.

Figure 4:
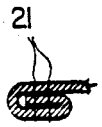
FIG. 4 is an enlarged view of the encircled portion designated IV in FIG. 3.
Figure 5:
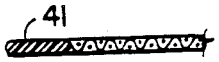
FIG. 5 is similar to FIG. 4, illustrating an alternative embodiment.

The band can be of any suitable material and preferably 100% cordura nylon material commonly used in making luggage. The band illustrated in FIG. 3 is reinforced along its opposite longitudinal, marginal edges by a double, folded over edge (see FIG. 4) anchored by double or triple lines of stitching 21,22. As an alternative to this, in FIG. 5 there is illustrated a heat and/or chemically fused edge, designated 41.

The fabric material is preferably relatively flexible, so that the loops 25 and 26 around the handgrips can be pushed forwardly when not in use, so as to not interfere with the invalids use of the walker. When the user desires to sit, all he need do is slide the loops back, straightening out the band, thereby providing a hammock type seat right at hand, avoiding the necessity of finding a chair or other suitable support on which to sit.

Figure 10:
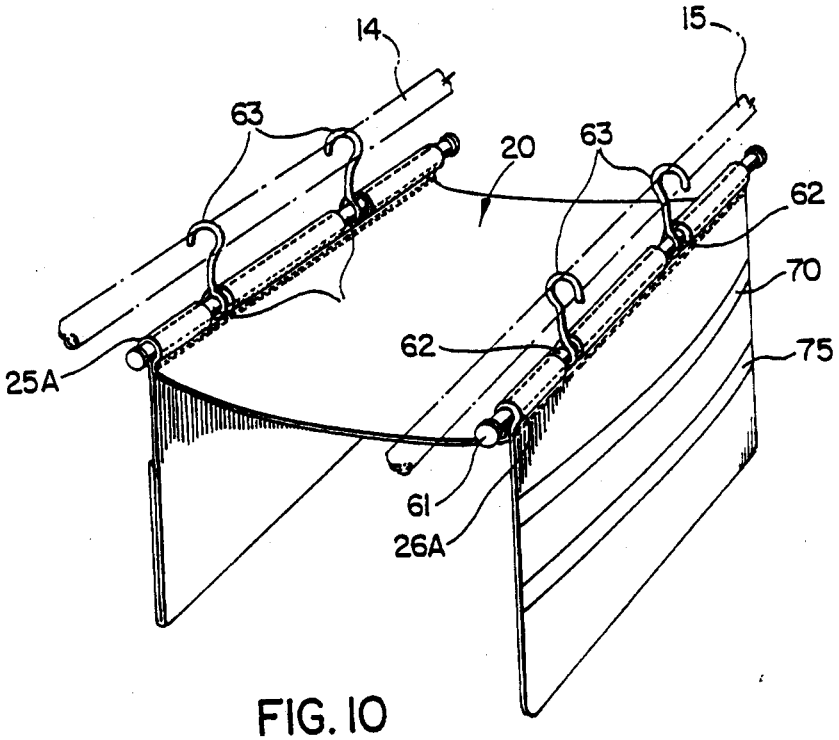
FIG. 10 is an oblique partial view of a walker and seat detachably attached thereto by further mounting means.

FIG. 10 there is illustrated further modifications to the seat of the walker and mounting thereof on the walker. Referring to FIG. 10, the seat 20 is provided with relatively small loops 25A and 26A for receiving respective ones of a pair of rods designated 60 and 61. Slots 62, in the loops, provide access for hooking one end of hooks 63 onto the rod. Hooks 63, illustrated in FIG. 10, are S-hooks which have the other end hooked onto handrails 14 and 15. The S-hooks 63 can be detachable from either the handrails 14 and 15 or rods 60 and 61 or both. Also, instead of using S-hooks 63, as illustrated in FIG. 10, the hooks can be attached permanently in any convenient manner to the handrails 14 and 15 and depend downwardly therefrom for catching on to the rods 60 and 61 through the access opening 62.

The loops 25A and 26A are provided by joining the band to itself as by sewing or other convenient means.

FIG. 10, there is also illustrated an elastic band 70 on the flap of the pouch to tighten the opening thereto. An elastic band 75 can also be provided outside of the pouch for holding further articles, should one so desire.

We claim:

1. An improved invalid walker comprising a frame having legs an a pair of spaced apart upper horizontal handrails for grasping by the user of the walker and a flexible band mounted on said handrails and depending therefrom selectively providing a seat between said handrails said band having an openable closure means adjacent at least one of the handrails whereby said band may be disconnected and said handrail may be used as a support for an invalid, said band having at least one of opposite ends thereof depending downwardly from the handrail associated therewith and including at least one pocket on at least one of said downwardly depending end portions.

2. An invalid walker as defined in claim 1 wherein said flexible band has loops to receive a respective one of said handrails.

3. An invalid walker as defined in claim 2 wherein said loops are an integral part of the band.

4. An invalid walker as defined in claim 1, wherein said flexible band includes loops at opposite ends thereof for attachment to said handrails and said openable closure is provided on at least one of said loops rendering the same removably mountable on the handrail associated therewith.

5. An invalid walker as defined in claim 4, wherein said openable closure comprises a zipper.

6. A band detachably mountable on an invalid walker selectively to provide a seat for the user of the walker, said band comprising a continuous length having reinforcements extending lengthwise along opposite marginal edges of the band and with opposed ends of said band folded upon itself and attached along a portion of said marginal edges providing open top pockets and a pair of parallel spaced apart loops in said bands extending transversely across the width thereof; said loops being formed by a fold in the band and including means joining the band together at a position spaced from the fold, said loops being positioned to a receive respective ones of a pair of spaced apart horizontal handrails on the walker and openable closure means for at least one of said parallel spaced apart loops making said band at least partially removable from said walker.

7. A band as defined in claim 6 wherein said openable closure means comprises a zipper.

8. A band as defined in claim 7 wherein said zipper comprises a first openable closure means for the loop and including a second closure means, disposed between the handrail of the walker and said first closure means.

9. An invalid walker comprising a frame having legs and a pair of upper horizontal handrails spaced apart from one another for grasping by the user of the walker and a band of flexible material suspended from said handrails providing a seat therebetween for the user of the walker; said band having a pair of spaced apart loops therein receiving respective ones of said handrails and, one of said loops including openable closure means rendering such loop removably mountable on the handrail associated therewith; said band being a continuous strip of material and having opposite end portions depending freely downwardly from said handrails and including an open top article holding pocket on at least one of said downwardly depending end portions.

10. An invalid walker as defined in claim 9, wherein said openable closure comprises a zipper.

11. An invalid walker as defined in claim 9, wherein said continuous strip has reinforcement along opposite longitudinal edges of said band.

* * * * *